US009976713B2

(12) United States Patent
Schevciw et al.

(10) Patent No.: US 9,976,713 B2
(45) Date of Patent: May 22, 2018

(54) APPARATUS AND METHOD FOR PROVIDING A FREQUENCY RESPONSE FOR AUDIO SIGNALS

(71) Applicant: QUALCOMM Incorporated, San Diego, CA (US)

(72) Inventors: Andre Gustavo Pucci Schevciw, San Diego, CA (US); Ricardo De Jesus Bernal Castillo, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 206 days.

(21) Appl. No.: 14/132,928

(22) Filed: Dec. 18, 2013

(65) Prior Publication Data

US 2015/0010176 A1 Jan. 8, 2015

Related U.S. Application Data

(60) Provisional application No. 61/843,276, filed on Jul. 5, 2013.

(51) Int. Cl.

| | |
|---|---|
| ***F21S 8/02*** | (2006.01) |
| ***H04R 17/00*** | (2006.01) |
| ***H04R 23/02*** | (2006.01) |
| *H04R 1/24* | (2006.01) |

(52) U.S. Cl.

CPC ..... *F21S 8/02* (2013.01); *H04R 17/00* (2013.01); *H04R 23/02* (2013.01); *H04R 1/24* (2013.01); *H04R 2499/11* (2013.01)

(58) Field of Classification Search

CPC ..... H04R 23/02; H04R 17/00; H04R 17/005; H04R 17/025; H04R 2217/00; H04R 15/00; H04R 15/02; H04R 11/00; H04R 9/00; H04R 9/06; H01L 41/00

USPC .... 381/190, 191; 310/321, 323.01, 322, 334

See application file for complete search history.

(56) References Cited

U.S. PATENT DOCUMENTS

| | | | | |
|---|---|---|---|---|
| 4,242,541 A | | 12/1980 | Ando | |
| 4,823,042 A | * | 4/1989 | Coffey | A61H 23/0245 310/312 |
| 6,332,029 B1 | * | 12/2001 | Azima | B42D 15/022 181/166 |
| 8,139,762 B2 | * | 3/2012 | Kuroda | H04M 1/03 379/433.02 |
| 8,934,228 B2 | * | 1/2015 | Franklin | G06F 1/1652 361/679.26 |

(Continued)

FOREIGN PATENT DOCUMENTS

| | | | |
|---|---|---|---|
| EP | 0772373 A2 * | 5/1997 | H04R 9/06 |
| EP | 2519031 A1 | 10/2012 | |

(Continued)

OTHER PUBLICATIONS

International Search Report and Written Opinion for International Application No. PCT/US2014/042678, ISA/EPO, dated Sep. 11, 2014, 9 pages.

*Primary Examiner* — Oyesola C Ojo

(74) *Attorney, Agent, or Firm* — Toler Law Group, P.C.

(57) ABSTRACT

An apparatus includes a moving mass transducer. The moving mass transducer generates sound by displacement of a surface defined by a piezoelectric element. The piezoelectric element is displaced in response to an interaction of a first signal with a magnetic field. The piezoelectric element is configured to be separately driving by a second signal.

28 Claims, 4 Drawing Sheets

(56) References Cited

U.S. PATENT DOCUMENTS

| | | | | |
|---|---|---|---|---|
| 2005/0185809 | A1* | 8/2005 | Bianchini | 381/190 |
| 2006/0239479 | A1* | 10/2006 | Schobben | H04M 1/0266 381/306 |
| 2007/0064955 | A1* | 3/2007 | Saito | H04R 5/04 381/58 |
| 2010/0067726 | A1* | 3/2010 | Suzuki | G06F 1/1605 381/333 |
| 2010/0260371 | A1* | 10/2010 | Afshar | 381/394 |
| 2012/0243719 | A1* | 9/2012 | Franklin | G06F 1/1652 381/333 |
| 2012/0257772 | A1* | 10/2012 | Onishi | H04R 23/02 381/190 |
| 2014/0378191 | A1* | 12/2014 | Hosoi | H04M 1/6066 455/575.1 |

FOREIGN PATENT DOCUMENTS

| | | | | | |
|---|---|---|---|---|---|
| FR | 2983025 | A1 | | 5/2013 | |
| JP | 56149900 | | * | 11/1981 | H04R 23/02 |
| JP | 62221300 | | * | 9/1986 | H04R 23/02 |
| JP | 62003598 | | * | 1/1987 | H04R 3/04 |
| JP | S62221300 | A | | 9/1987 | |
| JP | 63279700 | | * | 11/1988 | H04R 23/02 |
| JP | 2008124738 | A | | 5/2008 | |
| WO | 0018182 | A1 | | 3/2000 | |

* cited by examiner

APPARATUS AND METHOD FOR PROVIDING A FREQUENCY RESPONSE FOR AUDIO SIGNALS

I. CLAIM OF PRIORITY

The present application claims priority from U.S. Provisional Application No. 61/843,276, filed Jul. 5, 2013, which is entitled "APPARATUS AND METHOD FOR PROVIDING A FREQUENCY RESPONSE FOR AUDIO SIGNALS," the content of which is incorporated by reference in its entirety.

II. FIELD

The present disclosure is generally related to providing a frequency response for audio signals.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player. Also, such wireless telephones can process executable instructions, including software applications, such as a web browser application, that can be used to access the Internet. As such, these wireless telephones can include significant computing capabilities.

Sound reproduction capabilities for portable computing devices may be limited. For example, wireless telephones may support audio signal reproduction for audio signals within a narrow acoustic frequency range. However, there is increasing demand to support audio signal reproduction for a wider range of acoustic frequencies. To illustrate, there is demand for wireless telephones to support audio signals within a Super Wideband frequency range (e.g., from approximately 50 hertz (Hz) to approximately 14 kilohertz (kHz)) and/or Ultrasound signals (e.g., signals ranging from approximately 20 kHz to above 60 kHz). Conventional earpieces of wireless telephones are not able to provide high fidelity frequency response for each audio signal within the Super Wideband frequency range or for Ultrasound signals. For example, transducers designed for low frequency response may require a large radiation surface (e.g., diaphragm) to provide air pumping capacity at low frequencies. However, high frequency signals may cause the diaphragm to vibrate, resulting in an irregular frequency response. Further, the response of elements in a conventional transducer may change due to environmental factors which may limit a range of detection for applications using higher frequency signals (e.g., Ultrasound signals). For example, changes in temperature may cause the diaphragm of a traditional transducer to stiffen, limiting the transducer response to high frequency signals.

IV. SUMMARY

A method and an apparatus are disclosed for providing a frequency response for audio signals within a Super Wideband frequency range, a frequency response for Ultrasound signals, or both. An audio signal may include high frequency components within an upper frequency band of the Super Wideband frequency range and low frequency components within a lower frequency band of the Super Wideband frequency range. Filters (e.g., high-pass filters and low-pass filters) may separate the high frequency components and the low frequency components. The low frequency components may be amplified and provided to a coil of a moving mass transducer, and the high frequency components of the audio signals may be amplified and provided to a surface (e.g., a piezoelectric element) of the moving mass transducer. For example, the high frequency components of the audio signals may separately drive the piezoelectric element. In response to an interaction of a magnetic field of the coil with a magnetic field of a magnet, the surface may move in a first manner (e.g., a moving mass that includes the piezoelectric element may translate or displace) to provide a frequency response for low frequency signals. Further, separately driving the piezoelectric element with amplified high frequency components of the audio signal may cause the piezoelectric element to move in a second manner (e.g., vibrate or fluctuate in shape) to provide a frequency response for high frequency signals.

In a particular embodiment, an apparatus includes a moving mass transducer. The moving mass transducer generates sound by displacement of a surface defined by a piezoelectric element. The piezoelectric element is displaced in response to an interaction of a first signal with a magnetic field. The piezoelectric element is configured to be separately driven by a second signal.

In another particular embodiment, a method includes driving a coil of a moving mass transducer with a first signal. The moving mass transducer generates sound by displacement of a surface defined by a piezoelectric element. The piezoelectric element is displaced in response to an interaction of the first signal with a magnetic field. The method further includes driving the piezoelectric element with a second signal.

In another particular embodiment, an apparatus includes means for driving a coil of a moving mass transducer with a first signal. The moving mass transducer generates sound by displacement of a surface defined by a piezoelectric element. The piezoelectric element is displaced in response to an interaction of the first signal with a magnetic field. The apparatus further includes means for driving the piezoelectric element with a second signal.

In another particular embodiment, a non-transitory computer readable medium includes instructions that, when executed by a processor, cause the processor to generate a first signal that drives a coil of a moving mass transducer. The moving mass transducer generates sound by displacement of a surface defined by a piezoelectric element. The piezoelectric element is displaced in response to an interaction of the first signal with a magnetic field. The instructions are also executable to cause the processor to generate a second signal that drives the piezoelectric element.

One particular advantage provided by at least one of the disclosed embodiments is an ability to provide a frequency response for audio signals within a Super Wideband frequency range (e.g., from approximately 50 hertz (Hz) to approximately 14 kilohertz (kHz)) using a relatively small audio reproduction system. Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
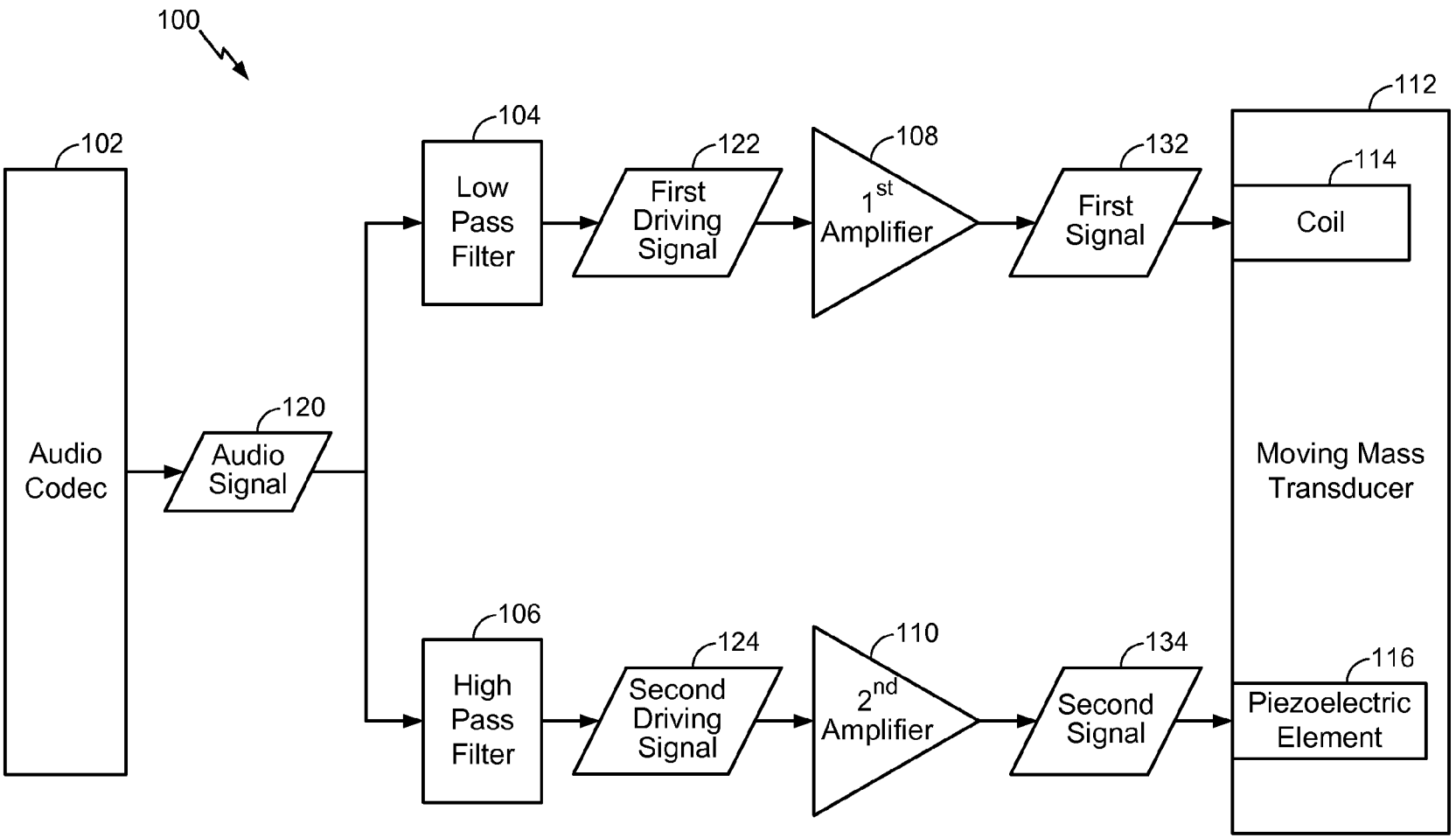
FIG. 1 is a block diagram of a particular illustrative embodiment of a system that is operable to provide a frequency response for audio signals within a particular frequency range.

Referring to FIG. 1, a particular illustrative embodiment of a system 100 that is operable to provide a frequency response for audio signals within a particular frequency range is shown. For example, the system 100 may be configurable to provide a frequency response for audio signals within a Super Wideband frequency range (e.g., from approximately 50 hertz (Hz) to approximately 14 kilohertz (kHz)) and/or an Ultrasound frequency range (e.g., over 20 kHz). The system 100 may include an audio encoder/decoder (CODEC) 102, a low pass filter 104, a high pass filter 106, a first amplifier 108, a second amplifier 110, and a moving mass transducer 112. The moving mass transducer 112 may include a coil 114 and a piezoelectric element 116 coupled to the coil 114 as part of a moving mass of the moving mass transducer 112.

The audio CODEC 102 may be configured to output an audio signal 120. For example, the audio CODEC 102 may include a digital-to-analog converter and may decode a digital audio signal to generate the audio signal 120 (e.g., an analog audio signal). In a particular embodiment, the audio signal 120 may have frequency components within the Super Wideband frequency range. For example, the audio signal 120 may have high frequency components ranging approximately from 1 kHz to 14 kHz, and the audio signal 120 may have low frequency components ranging approximately from 50 Hz to 1 kHz. The audio signal 120 may be provided to the low pass filter 104 and to the high pass filter 106.

The low pass filter 104 may be configured to receive the audio signal 120 and to generate a first driving signal 122 (e.g., a low frequency driving signal) by removing high frequency components of the audio signal 120. For example, the low pass filter 104 may provide low frequency components (e.g., components having a frequency below 1 kHz) of the audio signal 120 to the first amplifier 108, and the low pass filter 104 may block high frequency components of the audio signal 120 (e.g., reduce an amount of high frequency components of the audio signal 120 that are provided to the first amplifier 108). The high pass filter 106 may also be configured to receive the audio signal 120. The high pass filter 106 may be configured to generate a second driving signal 124 (e.g., a high frequency driving signal) by removing the low frequency components of the audio signal 120. For example, the high pass filter 106 may provide high frequency components (e.g., components having a frequency above 1 kHz) of the audio signal 120 to the second amplifier 110, and the high pass filter 106 may block low frequency components of the audio signal 120 (e.g., reduce an amount of low frequency components of the audio signal 120 that are provided to the second amplifier 110). Although, the "cut-off" frequencies of the low pass filter 104 and the high pass filter 106 are described with respect to a frequency of approximately 1 kHz, different frequencies may be used to improve the performance of the system 100. In a particular embodiment, the low pass filter 104 and the high pass filter 106 may have different "cut-off" frequencies. As a non-limiting example, the low pass filter 104 may block components of the audio signal 120 having a frequency above 1.3 kHz, and the high pass filter 106 may block components of the audio signal 120 having a frequency below 1.4 kHz.

The first amplifier 108 may be configured to receive the first driving signal 122 (e.g., the low frequency components of the audio signal 120) and to amplify the first driving signal 122 to generate a first signal 132 (e.g., an amplified first driving signal). The first amplifier 108 may provide the first signal 132 to the coil 114 of the moving mass transducer 112. In a particular embodiment, the first signal 132 may have a frequency within a first frequency band. The first frequency band may range from approximately 50 Hz to 1 kHz.

The second amplifier 110 may be configured to receive the second driving signal 124 (e.g., the high frequency components of the audio signal 120) and to amplify the second driving signal 124 to generate a second signal 134 (e.g., an amplified second driving signal). The second amplifier 110 may provide second signal 134 to the piezoelectric element 116 of the moving mass transducer 112. In a particular embodiment, the second signals 134 may have a frequency within a second frequency band. In a particular embodiment, the second frequency band may range from approximately 1 kHz to 15 kHz. In another particular embodiment, the second frequency band may range from approximately 1 kHz to 60 kHz to cover Ultrasound signals.

The coil 114 may be coupled to the first amplifier 108 to receive the first signal 132. In response to receiving the first signal 132, the coil 114 may produce a magnetic field which may interact with a magnetic field of a magnet (not shown) of the moving mass transducer 112, as described in further detail with respect to FIG. 2. The interaction of the magnetic fields may cause a moving mass of the moving mass transducer 112 to be translated. The moving mass of the moving mass transducer 112 may include a surface and the coil 114. For example, the moving mass transducer 112 may generate sound by displacement of the surface. The displacement of the surface may be partially associated with the translation of the moving mass. The surface may be defined by the piezoelectric element 116. In a particular embodiment, the surface of the moving mass, and thus the surface of the moving mass transducer 112, may be exclusively consist of the piezoelectric element 116. As described herein, the "surface" and the "piezoelectric element 116" may be used interchangeably.

The piezoelectric element 116 may be displaced in response to an interaction of the first signal 132 with a magnetic field. For example, the coil 114 may generate a magnetic field in response to the first signal 132 and a magnet within the moving mass transducer may generate another magnetic field. The interaction of the magnetic field generated by the coil 114 and the magnetic field generated by the magnet may cause the piezoelectric element 116 to translate. Thus, the piezoelectric element 116 may move in a first manner in response to the first signal 132. The translations of the piezoelectric element 116 may produce low frequency sounds waves (e.g., a low frequency response to the first signal 132).

The piezoelectric element 116 may be configured to be separately driven by the second signal 134. The piezoelectric element 116 may include, or be formed of, a piezoelectric material that exhibits the piezoelectric effect. That is, in response to an electric field, the piezoelectric material may change shape or external dimensions. In a particular embodiment, the piezoelectric material may include Berlinite, Quartz, Topaz, Barium Titanate, or any combination thereof. The second signal 134 may cause the piezoelectric material to exhibit the piezoelectric effect, causing the piezoelectric element 116 to move in a second manner. For example, separately driving the piezoelectric element 116 with the second signal 134 may cause a fluctuation in shape of the piezoelectric element 116. The displacement of the surface may be partially associated with the fluctuation in shape of the piezoelectric element 116. As the shape of the piezoelectric element 116 fluctuates, high frequency sound waves (e.g., a high frequency response to the second signal 134) may be produced.

The system 100 may generate sound waves over a Super Wideband frequency range by using a two-amplifier configuration to drive frequency components within an upper frequency band with the piezoelectric element 116 and to drive frequency components within a lower frequency band with the coil 114. For example, the system 100 may convert the high frequency components of the audio signal 120 into high frequency sound waves by changing the shape of the piezoelectric element 116. The system 100 may also covert the low frequency components of the audio signal 120 into low frequency sound waves by causing the piezoelectric element 116 operate as a moving mass (e.g., translate) in response to interactions of magnetic fields generated by the magnet and the coil 114. The sound waves produced by the piezoelectric element 116 may propagate through an acoustic port. For example, in a particular embodiment, the moving mass transducer 112 may be integrated into a handheld audio device (e.g., a portable telephone) having a glass housing with an acoustic port. For example, the acoustic port may be positioned over the moving mass transducer 112, and the audio CODEC 102 may be coupled to a processor of the handheld audio device as described with respect to FIG. 4. The sound waves produced by the moving mass transducer 112 may provide a frequency response for the audio signal 120.

Figure 2:
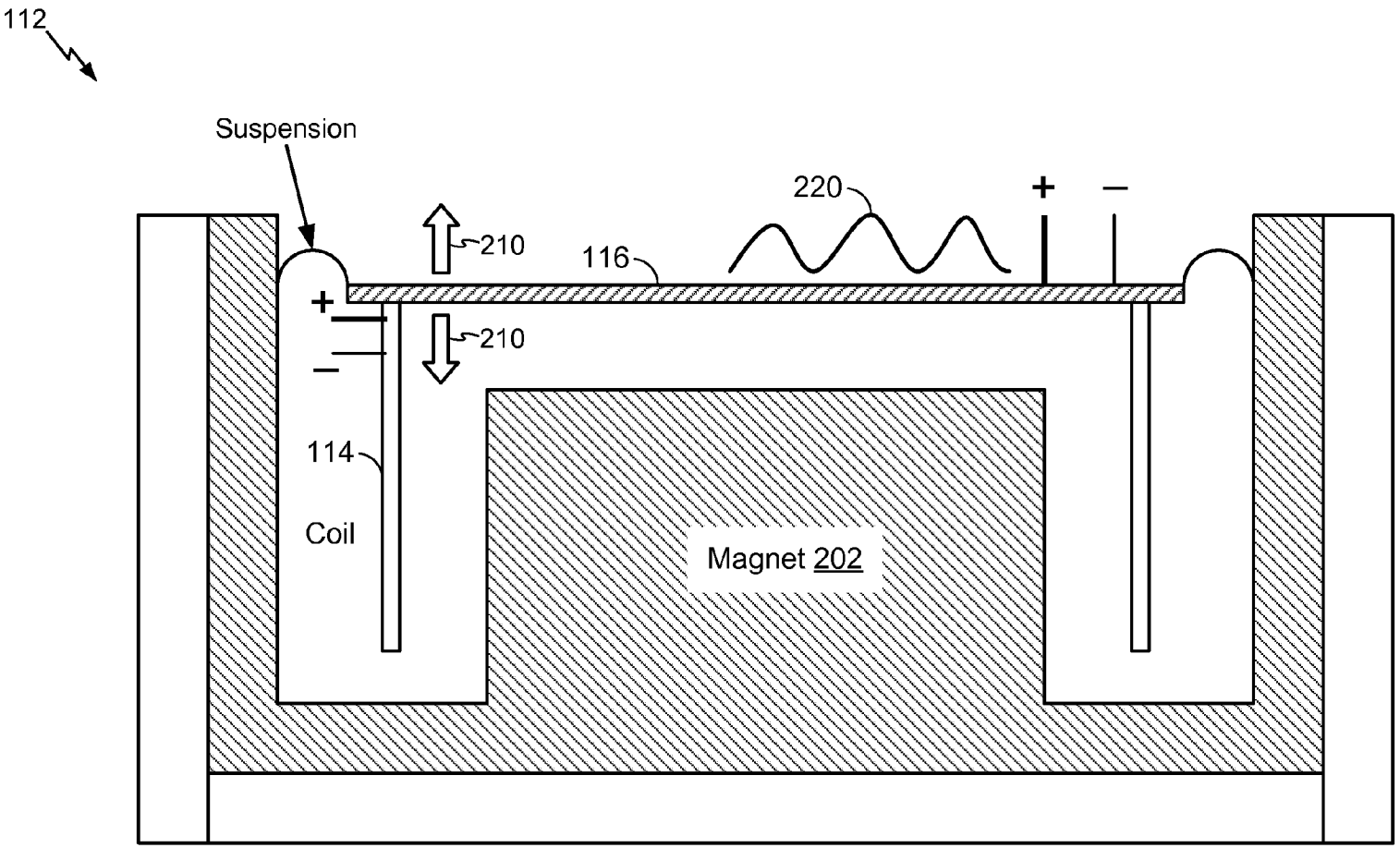
FIG. 2 is a diagram of a particular embodiment of a moving mass transducer of the system of FIG. 1.

Referring to FIG. 2, a diagram of a particular embodiment of the moving mass transducer 112 is shown. The moving mass transducer 112 may be coupled to a housing of a portable computing device (not shown) having an acoustic port.

The moving mass transducer 112 may include a magnet 202, the coil 114, and the piezoelectric element 116 (e.g., the surface). The coil 114 may be configured to receive the first signal 132 of FIG. 1. In response to receiving the first signal 132, the coil 114 may produce a magnetic field that interacts with a magnetic field of the magnet 202. In a particular embodiment, the magnet 202 may be a stationary magnet (e.g., substantially restricted from movement) and the force generated by the interaction of the magnetic fields may cause the piezoelectric element 116 and the coil 114 to operate as a moving mass and move in a first manner. For example, the interaction of the magnetic fields may cause the piezoelectric element 116 and the coil 114 to translate or displace (as illustrated by translation direction 210 in FIG. 2). The translations of the piezoelectric element 116 and the coil 114 may produce low frequency sounds waves (e.g., a low frequency response to the first signal 132). The piezoelectric element 116 may be coupled to the coil 114 and suspended from sides of the moving mass transducer 112. Suspending the piezoelectric element 116 from sides of the moving mass transducer 112 may allow the piezoelectric element 116 to move (e.g., translate) in response to the first signal 132. For example, the piezoelectric element 116 may operate as a moving mass (e.g., translate in the translation direction 210) in response to the force generated by the interaction of the magnetic fields.

The piezoelectric element 116 may also be configured to be separately driven by the second signal 134 of FIG. 1 to produce vibrations 220. For example, separately driving the piezoelectric element with the second signal 134 may cause a fluctuation in shape of the piezoelectric element 116. As the shape of the piezoelectric element 116 fluctuates, high frequency sound waves (e.g., a high frequency response to the second signal 134) may be produced.

Thus, the moving mass transducer 112 is able to generate sound waves (e.g., generate a frequency response) for low frequency signals and high frequency signals. For example, the piezoelectric element 116 may operate as a moving mass to produce low frequency sound waves by translating 210 in response to interactions of the magnetic fields generated by the magnet 202 and the coil 114. The low frequency sound waves may provide a frequency response to signals within a lower frequency band of the Super Wideband frequency range. In addition, by separately driving the piezoelectric element 116 with the second signal 134 of FIG. 1, the piezoelectric element 116 may produce high frequency sound waves by vibration 220. The high frequency sound waves may provide a frequency response to signals within a high frequency band of the Super Wideband frequency range. In addition, the high frequency sound waves may provide a frequency response to Ultrasound signals.

Figure 3:
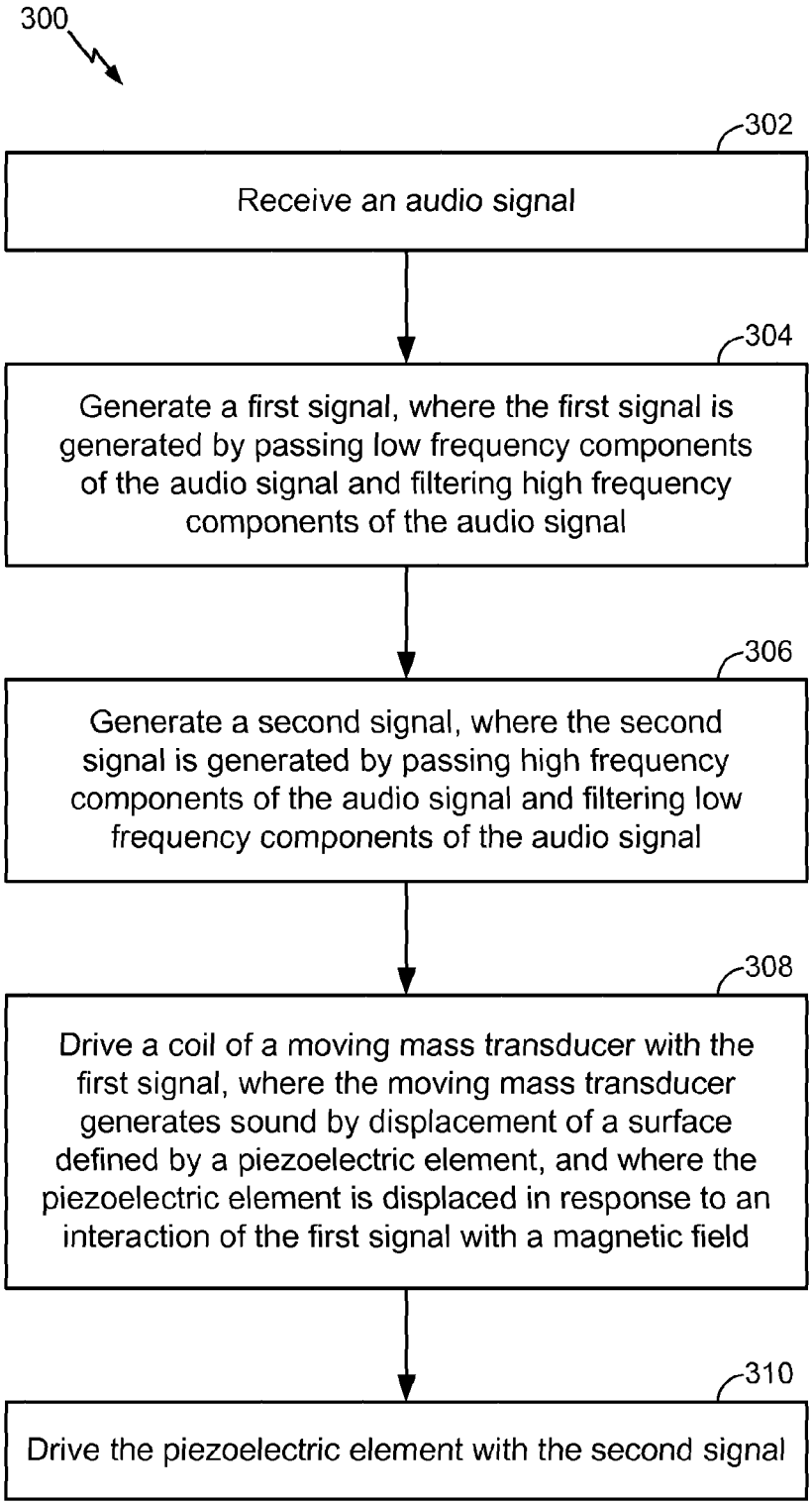
FIG. 3 is a flowchart of a particular embodiment of a method of providing a frequency response for audio signals within a particular frequency range.

Referring to FIG. 3, a particular embodiment of a method 300 of providing a frequency response for audio signals within an extended frequency range is shown. The method 300 may be performed by the system 100 of FIG. 1.

The method 300 includes receiving an audio signal, at 302. For example, in FIG. 1, the low pass filter 104 may receive the audio signal 120 from the audio CODEC 102 and the high pass filter 106 may also receive the audio signal 120 from the audio CODEC 102.

A first signal within a first frequency band may be generated, at 304. For example, in FIG. 1, the low pass filter 104 may pass low frequency components (e.g., components having a frequency below 1 kHz) of the audio signal 120 and filter (e.g., block or substantially reduce) high frequency components of the audio signal 120 to generate the first driving signal 122. The first driving signal 122 may be amplified by the first amplifier 108 to generate the first signal 132.

A second signal within a second frequency band may be generated, at 306. For example, in FIG. 1, the high pass filter 106 may pass high frequency components (e.g., components having a frequency above 1 kHz) of the audio signal 120 and filter (e.g., block or substantially reduce) low frequency components of the audio signal 120 to generate the second driving signal 124. The second driving signal 124 may be amplified by the second amplifier 110 to generate the second signal 134. The second frequency band may be higher than the first frequency band. For example, in a particular embodiment, the second frequency band may range from approximately from 1 kHz to 14 kHz and the first frequency band may range from approximately 50 Hz to 1 kHz.

A coil of a moving mass transducer may be driven with the first signal, at 308. For example, in FIG. 1, the coil 114 may be coupled to receive the first signal 132. In response to receiving the first signal 132, the coil 114 may generate a magnetic field, which may interact with the magnetic field of the magnet 202 of FIG. 2. The interaction of the magnetic fields causes the piezoelectric element 116 (e.g., the surface) to displace (e.g., translate in the translation direction 210). In a particular embodiment, the surface may be defined by the piezoelectric element 116. For example, the surface may be exclusively comprised of the piezoelectric element 116. The translations of the piezoelectric element 116 may produce low frequency sounds waves (e.g., a low frequency response to the first signal 132).

The piezoelectric element 116 may be driven with the second signal, at 310. For example, in FIG. 1, the piezoelectric element 116 may be separately driven by the second signal 134. Separately driving the piezoelectric element 116 with the second signal 134 may cause a fluctuation in shape (e.g., vibration) of the piezoelectric element 116. As the shape of the piezoelectric element 116 fluctuates, high frequency sound waves (e.g., a high frequency response to the second signal 134) may be produced.

In a particular embodiment, the method 300 includes amplifying the low frequency components of the audio signal before driving coil. For example, the first amplifier 108 may receive the first driving signal 122 (e.g., the low frequency components of the audio signal 120) and amplify the first driving signal 122 to generate the first signal 132 (e.g., an amplified first driving signal). In a particular embodiment, the method 300 includes amplifying the high frequency components of the audio signal before driving the piezoelectric element. For example, the second amplifier 110 may receive the second driving signal 124 (e.g., the high frequency components of the audio signal 120) and amplify the second driving signal 124 to generate a second signal 134 (e.g., an amplified second driving signal).

The method 300 may generate sound waves over a Super Wideband frequency range by using a two-amplifier configuration to drive frequency components within an upper frequency band with the piezoelectric element 116 and to drive frequency components within a lower frequency band with the coil 114. For example, the method 300 may convert the high frequency components of the audio signal 120 into high frequency sound waves by changing the shape of the piezoelectric element 116. The method 300 may covert the low frequency components of the audio signal 120 into low frequency sound waves by causing the piezoelectric element 116 to operate as a moving mass (e.g., translate) in response to the interaction of the magnetic fields generated by the magnet and the coil 114.

Figure 4:
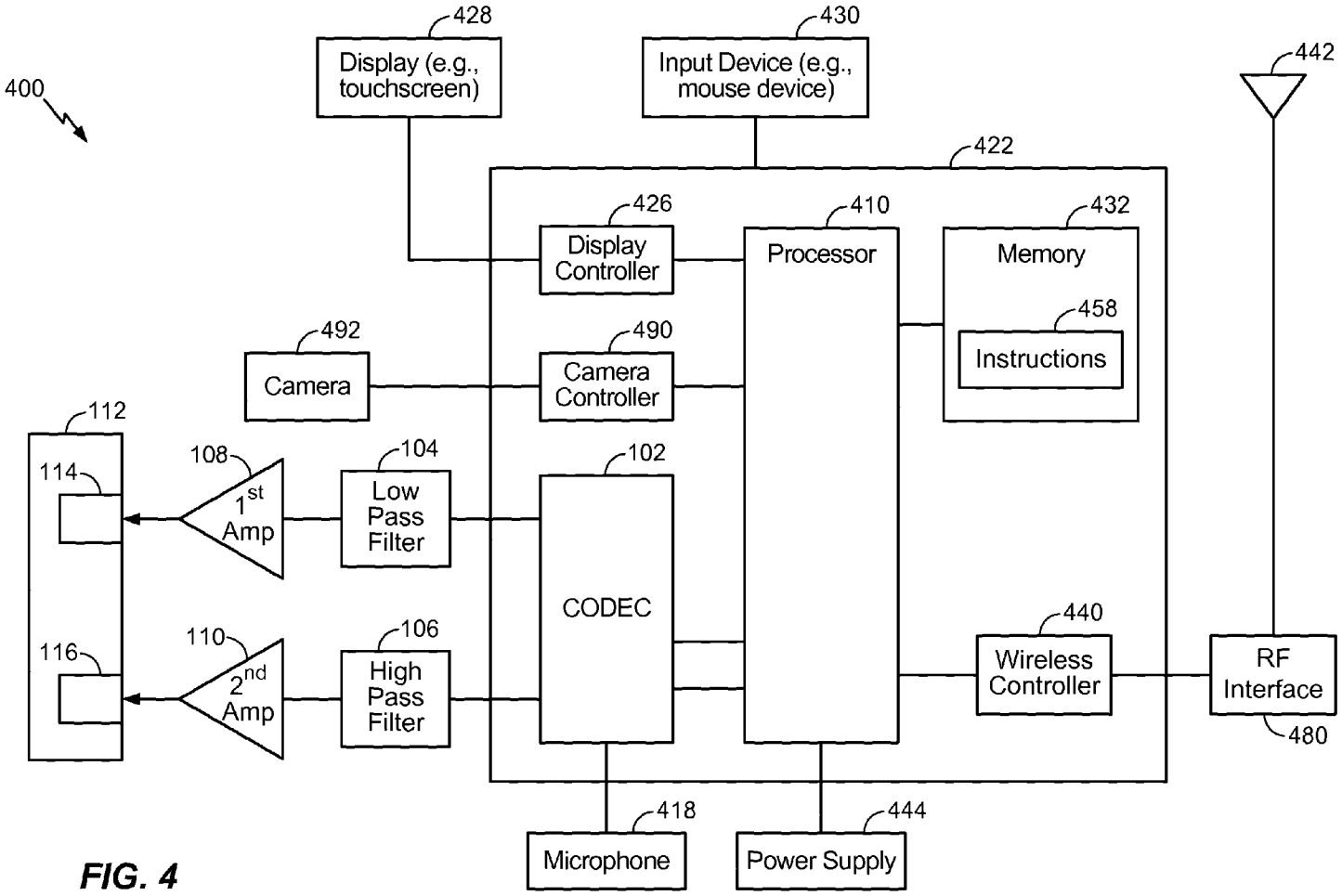
FIG. 4 is a block diagram of a wireless device including components that are operable to provide a frequency response for audio signals within a particular frequency range.

Referring to FIG. 4, a block diagram of a wireless device 400 including components that are operable to provide a frequency response for audio signals within a particular frequency range is shown. The device 400 includes a processor 410, such as a digital signal processor (DSP), coupled to a memory 432.

FIG. 4 also shows a display controller 426 that is coupled to the processor 410 and to a display 428. A camera controller 490 may be coupled to the processor 410 and to a camera 492. The device 400 may include the system 100 of FIG. 1. For example, the wireless device 400 includes the audio CODEC 102 of FIG. 1 coupled to the processor 410. The wireless device 400 also includes the low pass filter 104 of FIG. 1, the high pass filter 106 of FIG. 1, the first amplifier 108 of FIG. 1, the second amplifier 110 of FIG. 1, and the moving mass transducer 112 of FIG. 1. The moving mass transducer 112 may include the coil 114 coupled to receive the first signal of FIG. 1 and the piezoelectric element 116 configured to be separately driven by the second signal of FIG. 1. Thus, the moving mass transducer 112 may generate sound waves responsive to signals provided to the CODEC 102 by the processor 410. The signals may include voice call signals, streaming media signals received via an antenna 442, audio file playback signals, etc.

The memory 432 may be a tangible non-transitory processor-readable storage medium that includes instructions 458. The instructions 458 may be executed by a processor, such as the processor 410 or the components thereof, to perform the method 300 of FIG. 3. FIG. 4 also indicates that a wireless controller 440 can be coupled to the processor 410 and to the antenna 442 via a radio frequency (RF) interface 480. In a particular embodiment, the processor 410, the display controller 426, the memory 432, the CODEC 408, and the wireless controller 440 are included in a system-in-package or system-on-chip device 422. In a particular embodiment, an input device 430 and a power supply 444 are coupled to the system-on-chip device 422. Moreover, in a particular embodiment, as illustrated in FIG. 4, the display 428, the input device 430, a microphone 418, the antenna 442, the low pass filter 104, the high pass filter 106, the first amplifier 108, the second amplifier 110, the moving mass transducer 112, the piezoelectric element 116, the coil 114, the RF interface 480, and the power supply 444 are external to the system-on-chip device 422. However, each of the display 428, the input device 430, the microphone 418, the antenna 442, the low pass filter 104, the high pass filter 106, the first amplifier 108, the second amplifier 110, the moving mass transducer 112, the piezoelectric element 116, the coil 114, the RF interface 480, and the power supply 444 can be coupled to a component of the system-on-chip device 422, such as an interface or a controller.

In conjunction with the described embodiments, an apparatus is disclosed that includes means for driving a coil of a moving mass transducer with a first signal. The moving mass transducer generates sound by displacement of a surface defined by a piezoelectric element. The piezoelectric element is displaced in response to an interaction of the first signal with a magnetic field. The means for driving the coil may include the CODEC 102, the low pass filter 104 of FIG. 1, the first amplifier 108 of FIG. 1, the processor 410 programmed to execute the instructions 458 of FIG. 4, one or more other devices, circuits, or modules to drive the coil, or any combination thereof.

The apparatus may also include means for driving the piezoelectric element with a second signal. For example, the means for driving the piezoelectric element may include the CODEC 102 of FIG. 1, the high pass filter 106 of FIG. 1, the second amplifier 110 of FIG. 1, the processor 410 programmed to execute the instructions 458 of FIG. 4, one or more other devices, circuits, or modules to generate the second signal, or any combination thereof.

Those of skill would further appreciate that the various illustrative logical blocks, configurations, modules, circuits, and algorithm steps described in connection with the embodiments disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transient storage medium known in the art. An exemplary storage medium is coupled to the processor such that the processor can read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. An apparatus comprising: a moving mass transducer configured to:

receive a first filtered signal at a coil coupled to an amplifier;

receive a second filtered signal at a piezoelectric element, the second filtered signal having a first frequency higher than a second frequency of the first filtered signal; and generate sound by displacement of a surface of the moving mass transducer that is defined by the piezoelectric element, the piezoelectric element configured to be displaced in response to an interaction of the first filtered signal with a first magnetic field and to be separately driven by the second filtered signal;

an antenna;

a receiver coupled to the antenna and configured to receive an encoded audio signal, wherein the first filtered signal and the second filtered signal are based on the encoded audio signal;

a processor;

a memory coupled to the processor;

a coder-decoder (CODEC) coupled to the processor and coupled to the moving mass transducer;

a controller coupled to the processor; and a camera coupled to the controller, wherein the processor is configured to provide instructions to the controller and to the CODEC.

2. The apparatus of claim 1, wherein the first filtered signal and the second filtered signal are derived from an audio signal, and wherein a portion of the surface extending from a sidewall of the moving mass transducer to a connection of the piezoelectric element to the coil consists essentially of the piezoelectric element.

3. The apparatus of claim 1, wherein a moving mass of the moving mass transducer comprises the surface and the coil, and wherein the moving mass transducer is further configured to provide a frequency response ranging from 50 hertz (Hz) to over 20 kilohertz (kHz).

4. The apparatus of claim 1, wherein:

the coil is configured to generate a second magnetic field in response to the first filtered signal, and the surface is configured to translate in a translation direction in response to an interaction of the second magnetic field and the first magnetic field and to concurrently change shape in response to the second filtered signal.

5. The apparatus of claim 1, wherein the displacement of the surface is at least partially associated with a translation of the surface in a translation direction, and wherein separately driving the piezoelectric element by the second filtered signal causes a change to a shape of the surface.

6. The apparatus of claim 1, wherein the surface comprises a single membrane suspended over a magnet and connected to the coil, and wherein a shape of the surface is configured to change responsive to the second filtered signal to selectively drive the piezoelectric element.

7. The apparatus of claim 1, wherein the surface is substantially planar, wherein the surface is suspended over a magnet, wherein the surface is configured to fluctuate responsive to the second filtered signal to separately drive the piezoelectric element, and wherein the displacement of the surface is at least partially associated with fluctuation of the surface.

8. The apparatus of claim 7, wherein the first filtered signal includes a third frequency lower than a fourth frequency filtered from an audio signal to generate the second filtered signal.

9. The apparatus of claim 1, further comprising an encoder/decoder (CODEC), wherein:

the amplifier is coupled between the coil and the CODEC, a second amplifier is coupled between the piezoelectric element and the CODEC, and the second filtered signal has a frequency above approximately twenty kilohertz (kHz).

10. The apparatus of claim 1, wherein:

the moving mass transducer is configured to receive the first filtered signal from a first filter that comprises a first cut-off frequency, the moving mass transducer is configured to receive the second filtered signal from a second filter that comprises a second cut-off frequency, and the second filtered signal includes a particular frequency between the second cut-off frequency and approximately sixty kilohertz (kHz).

11. The apparatus of claim 1, further comprising:

a low pass filter configured to pass low frequency components of an audio signal to generate a low frequency driving signal;

the amplifier configured to amplify the low frequency driving signal, wherein the first filtered signal corresponds to the amplified low frequency driving signal;

a high pass filter configured to pass high frequency components of the audio signal to generate a high frequency driving signal; and a second amplifier configured to amplify the high frequency driving signal, wherein the second filtered signal corresponds to the amplified high frequency driving signal.

12. The apparatus of claim 1, wherein the moving mass transducer is integrated into a handheld audio device having a glass housing, the glass housing having an acoustic port that is positioned over the moving mass transducer, and wherein the surface is exclusively comprised of the piezoelectric element.

13. A method comprising:

receiving, at a moving mass transducer, a first filtered signal and a second filtered signal, the second filtered signal having a first frequency higher than a second frequency of the first filtered signal;

driving a coil of the moving mass transducer with the first filtered signal, wherein the coil is coupled to an amplifier;

generating sound by displacement of a surface defined by a piezoelectric element of the moving mass transducer, the piezoelectric element displaced in response to an interaction of the first filtered signal with a first magnetic field;

driving the piezoelectric element with the second filtered signal;

receiving, by the coil, the first filtered signal;

generating a second magnetic field in response to the first filtered signal, wherein an interaction of the second magnetic field of the coil and the first magnetic field of a magnet causes translation of the surface; and causing a shape of the surface to fluctuate in response to driving the piezoelectric element with the second filtered signal, wherein the displacement of the surface is at least partially associated with the translation.

14. The method of claim 13, wherein generating the sound by displacement of the surface comprises displacing a portion of the surface that extends from a sidewall of the moving mass transducer to a connection of the piezoelectric element to the coil, and wherein the portion of the surface consists essentially of the piezoelectric element.

15. The method of claim 13, further comprising moving a first portion of the moving mass transducer, the first portion comprising the surface and the coil.

16. The method of claim 13, further comprising causing a shape of the surface to fluctuate in response to driving the piezoelectric element with the second filtered signal, wherein the surface is substantially planar, wherein the surface is suspended over a magnet, wherein the displacement of the surface is at least partially associated with the fluctuation, and wherein frequency components of the second filtered signal correspond to an ultrasound frequency range.

17. The method of claim 13, further comprising:

generating the first filtered signal, wherein the first filtered signal is generated by passing low frequency components of an audio signal and filtering high frequency components of an audio signal; and generating the second filtered signal, wherein the second filtered signal is generated by passing high frequency components of the audio signal and filtering low frequency components of the audio signal.

18. The method of claim 13, further comprising driving the piezoelectric element with an ultrasound frequency, wherein the moving mass transducer is integrated into a handheld audio device having a glass housing that includes an acoustic port positioned over the moving mass transducer.

19. The method of claim 13, wherein the first filtered signal is generated with a first cut-off frequency, wherein the second filtered signal is generated with a second cut-off frequency, and wherein the piezoelectric element is driven with a frequency between approximately the second cut-off frequency and sixty kilohertz (kHz).

20. An apparatus comprising:

means for receiving a first filtered signal and a second filtered signal, the second filtered signal having a first frequency higher than a second frequency of the first filtered signal;

means for driving a coil of a moving mass transducer with the first filtered signal, the moving mass transducer configured to generate sound by displacement of a surface of the moving mass transducer that is defined by a piezoelectric element, the piezoelectric element configured to be displaced in response to an interaction of the first filtered signal with a first magnetic field, wherein the coil is coupled to an amplifier;

means for driving the piezoelectric element with the second filtered signal;

an antenna;

a receiver coupled to the antenna and configured to receive an encoded audio signal, wherein the first filtered signal and the second filtered signal are based on the encoded audio signal;

a processor;

a memory coupled to the processor;

a coder-decoder (CODEC) coupled to the processor and coupled to the moving mass transducer;

a controller coupled to the processor; and a camera coupled to the controller, wherein the processor is configured to provide instructions to the controller and to the CODEC.

21. The apparatus of claim 20, wherein a portion of the surface extending from a sidewall of the moving mass transducer to a connection of the piezoelectric element to the coil consists essentially of the piezoelectric element.

22. The apparatus of claim 21, wherein a moving mass of the moving mass transducer comprises the surface and the coil, and wherein the coil is configured to receive the first filtered signal.

23. The apparatus of claim 22, wherein the coil is configured to generate a second magnetic field in response to the first filtered signal, the second magnetic field of the coil configured to interact with the first magnetic field of a magnet to cause translation of the surface.

24. The apparatus of claim 20, wherein the means for driving the piezoelectric element is configured to cause a change to a shape of the surface.

25. A non-transitory computer readable medium comprising instructions that, when executed by a processor, cause the processor to:

generate a first filtered signal from an audio signal, the first filtered signal configured to drive a coil of a moving mass transducer, the moving mass transducer configured to generate sound by displacement of a surface defined by a piezoelectric element, the piezoelectric element configured to be displaced in response to an interaction of the first filtered signal with a first magnetic field, wherein the coil is coupled to an amplifier;

generate a second filtered signal from the audio signal, the second filtered signal having a first frequency that is higher than a second frequency of the first filtered signal, and the second filtered signal configured to drive the piezoelectric element; and transmit the first filtered signal and the second filtered signal to the moving mass transducer, wherein the moving mass transducer is included in a device, the device further comprising an antenna, a receiver coupled to the antenna and configured to receive an encoded audio signal, the processor, a memory coupled to the processor, a coder-decoder (CODEC) coupled to the processor and coupled to the moving mass transducer, a controller coupled to the processor, and a camera coupled to the controller, wherein the processor is configured to provide instructions to the controller and to the CODEC, and wherein the first filtered signal and the second filtered signal are based on the encoded audio signal.

26. The non-transitory computer readable medium of claim 25, wherein a portion of the surface extending from a sidewall of the moving mass transducer to a connection of the piezoelectric element to the coil consists essentially of the piezoelectric element.

27. The apparatus of claim 1, wherein the moving mass transducer, the antenna, and the receiver are integrated into a mobile communication device.

28. The method of claim 13, wherein the moving mass transducer is included in a device that comprises a mobile communication device.

* * * * *